US005589729A

United States Patent [19]

Descombes et al.

[11] Patent Number: 5,589,729

[45] Date of Patent: Dec. 31, 1996

[54] DEFLECTION YOKE LINER WITH SUPPORT RIDGES

[75] Inventors: Jean-Philippe Descombes, Premières; Philippe Marotte, Genlis, both of France

[73] Assignee: Thomson Tubes & Displays, S.A., France

[21] Appl. No.: 464,431

[22] Filed: Jun. 5, 1995

[30] Foreign Application Priority Data

Jul. 1, 1994 [EP] European Pat. Off. ..... 94401503

[51] Int. Cl.[6] ..... H01J 29/82; H01J 29/76

[52] U.S. Cl. ..... 313/440; 335/213; 335/297; 335/299

[58] Field of Search ..... 313/440; 335/210, 335/211, 212, 213, 303, 278, 296, 297, 299; 348/829

[56] References Cited

U.S. PATENT DOCUMENTS

| | | | |
|---|---|---|---|
| 4,749,975 | 6/1988 | Tokita et al. | 335/217 |
| 4,785,272 | 11/1988 | Osseyran | 335/213 |
| 4,786,838 | 11/1988 | Meershoek et al. | 313/440 |
| 4,821,407 | 4/1989 | Van de Meerakker | 29/605 |
| 5,138,290 | 8/1992 | Togane et al. | 313/440 X |
| 5,225,737 | 7/1993 | Sato | 335/213 X |
| 5,378,961 | 1/1995 | Shiro et al. | 313/440 |

FOREIGN PATENT DOCUMENTS

| | | | |
|---|---|---|---|
| 0540113 | 5/1993 | European Pat. Off. . | |
| 1233067 | 1/1967 | Germany . | |
| 0012743 | 1/1990 | Japan | 313/440 |
| 4087240 | 3/1992 | Japan | 313/440 |
| 0073842 | 3/1992 | Japan | 313/440 |

*Primary Examiner*—Sandra L. O'Shea
*Assistant Examiner*—Ashok Patel
*Attorney, Agent, or Firm*—Joseph S. Tripoli; Joseph J. Laks; Sammy S. Henig

[57] ABSTRACT

A deflection yoke for a cathode ray tube includes a pair of vertical deflection coils, a pair of horizontal deflection coils and a rigid separator or yoke liner isolating the pairs of deflection coils from each other. The separator has a constant thickness and has on its inside face supporting ridges of a variable height for supporting the horizontal deflection coils.

9 Claims, 4 Drawing Sheets

DEFLECTION YOKE LINER WITH SUPPORT RIDGES

The invention relates to a deflection yoke for a cathode ray tube (CRT), and more particularly to a deflection yoke liner.

FIG. 1 illustrates a prior art deflection yoke 1 including a pair of saddle-shaped horizontal deflection coils 3, a pair of vertical deflection coils, also saddle-shaped, that are separated from coils 3 by a yoke liner or separator 2. Separator 2 may be made of plastic using injection mold manufacturing techniques. A core 5 made of ferromagnetic material is placed around coils 3 and 4. The assembly is disposed around a neck 8 of a cathode ray tube 6 to deflect electron beams produced in electron gun 7 for scanning a screen surface 9 of the tube. The various parts of yoke 1 can be maintained in an optimum adjustment position by bonding and/or clipping. Separator 2 ensures support for the various components and adds to the mechanical rigidity of the assembly. Typically, the distance between the two pairs of coils is established by the thickness of the separator.

Typically, to facilitate ease of manufacturing of the separator, the thickness of the separator is chosen to be constant. This imposes a constraint on the design of the horizontal and vertical deflection coils. Thus, the shape of the horizontal deflection coils, for example, would also determine the shape of the vertical deflection coils.

On the other hand, if the shape of the coils were made to be independent of each other, then the space between the horizontal and vertical deflection coils might have to be filled by the separator. The result is a variable thickness separator. The complex shape of such inside and outside faces of the variable thickness separator could make the separator difficult to manufacture. Thus, considerable thickness in some places of the separator may result in excessive weight and consumption of material. In addition, any design modification to the shape of a given pair of the coils, disadvantageously, may require a significant change to the inside and/or outside face or surface of the separator. The result is a significant change to the manufacturing molds. It may be desirable to make the separator with, generally, a constant thickness and also to provide for a variable radial position or displacement of, for example the horizontal deflection coils that abut an inner surface of the separator.

In a separator, embodying an inventive feature, the separator has, generally, a constant thickness. Support ridges are provided on the surface of the separator that abuts a deflection coil. The ridges may have a height that varies as a function of the angular position or the longitudinal coordinate of the corresponding, portion of the ridge. In this way, the ridge can provide a variable displacement of the deflection coil in the radial direction.

A deflection-yoke, embodying an aspect of the invention, includes a deflection coil. A separator is used for supporting the deflection coil. The separator has a plurality of support ridges for supporting the deflection coil. The deflection coil bears against the support ridges in a manner to space the deflection coil from a surface of the separator.

Figure 1:
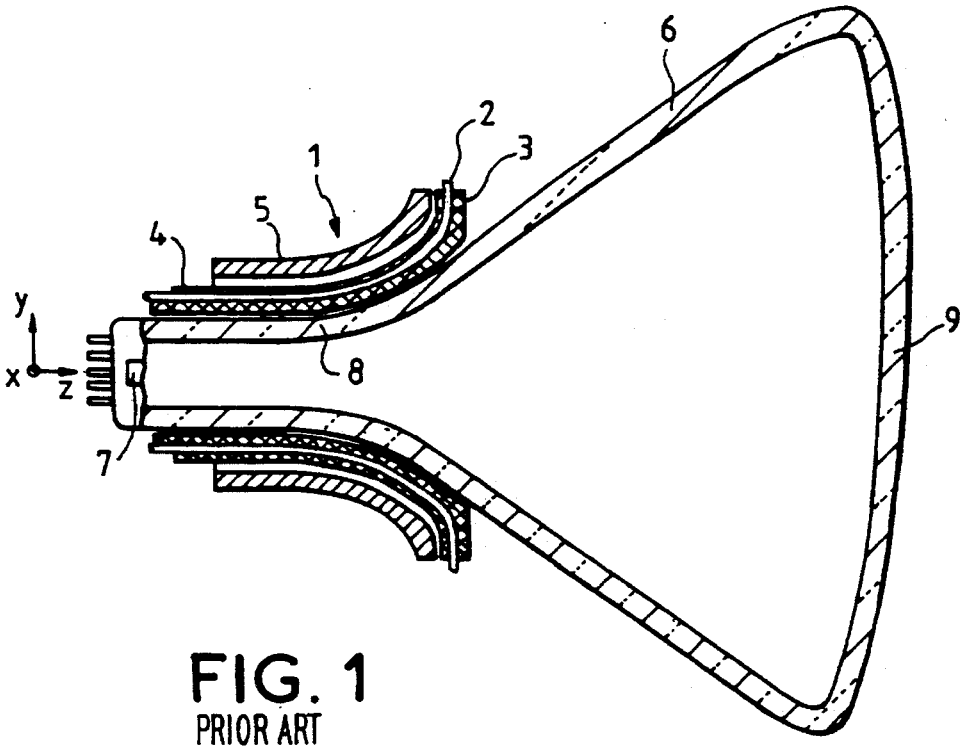
FIG. 1 PRIOR ART
FIG. 1 illustrates a longitudinal section of a cathode ray tube and of a prior art deflection yoke mounted on the neck of the tube.
Figure 2:
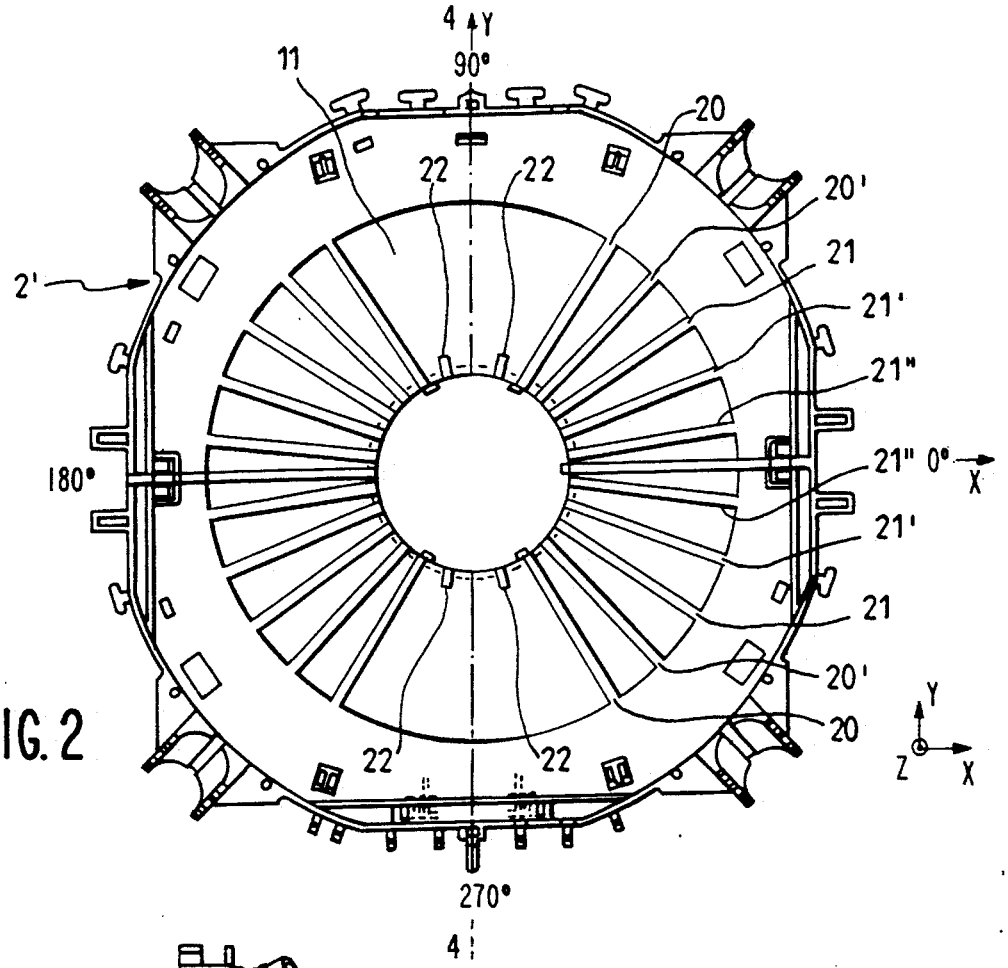
FIG. 2 illustrates a front view of a separator, embodying an inventive feature.
Figure 3:
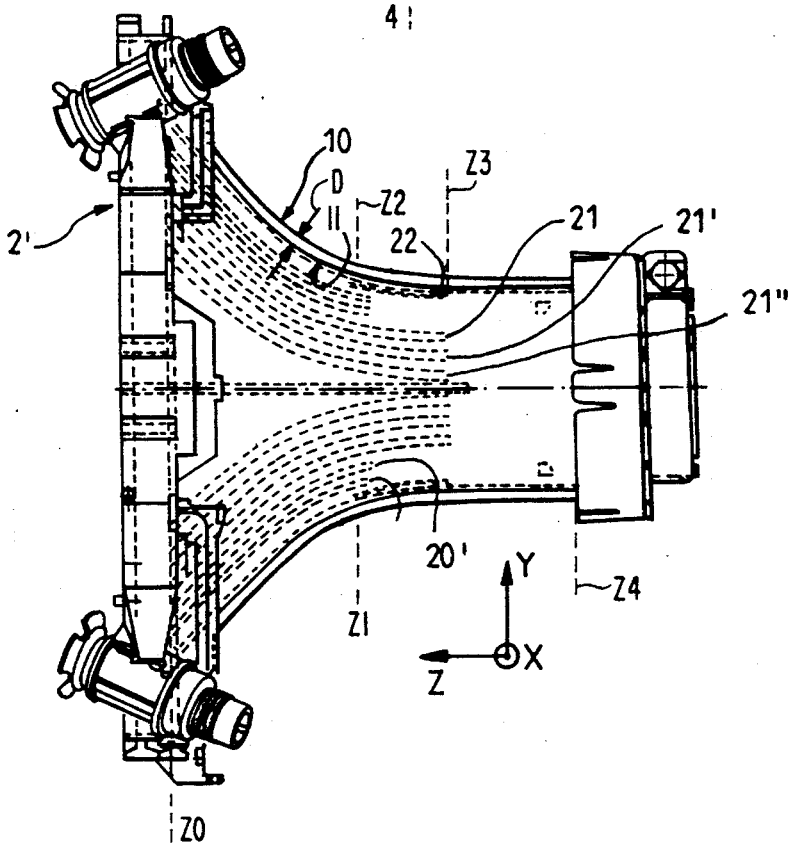
FIG. 3 illustrates a side view of the separator of FIG. 2.

FIGS. 2 to 5 depict a separator 2', embodying an inventive feature. Similar symbols and numerals in FIGS. 1 to 5 indicate similar items or functions. An inside face or surface 11 of separator 2' of FIGS. 2 and 3 and an outside face or surface 10 of separator 2' of FIG. 3 are designed to form a body of revolution in a manner to facilitate the engagement and disengagement of sections of a mold, not shown, used for producing separator 2'. A distance D between surfaces 10 and 11 is maintained, generally, constant in order to maintain an easily manufactured shape. An inside surface of the vertical deflection coils, not shown, bears against or abuts outside surface 10 of separator 2'.

Figure 5:
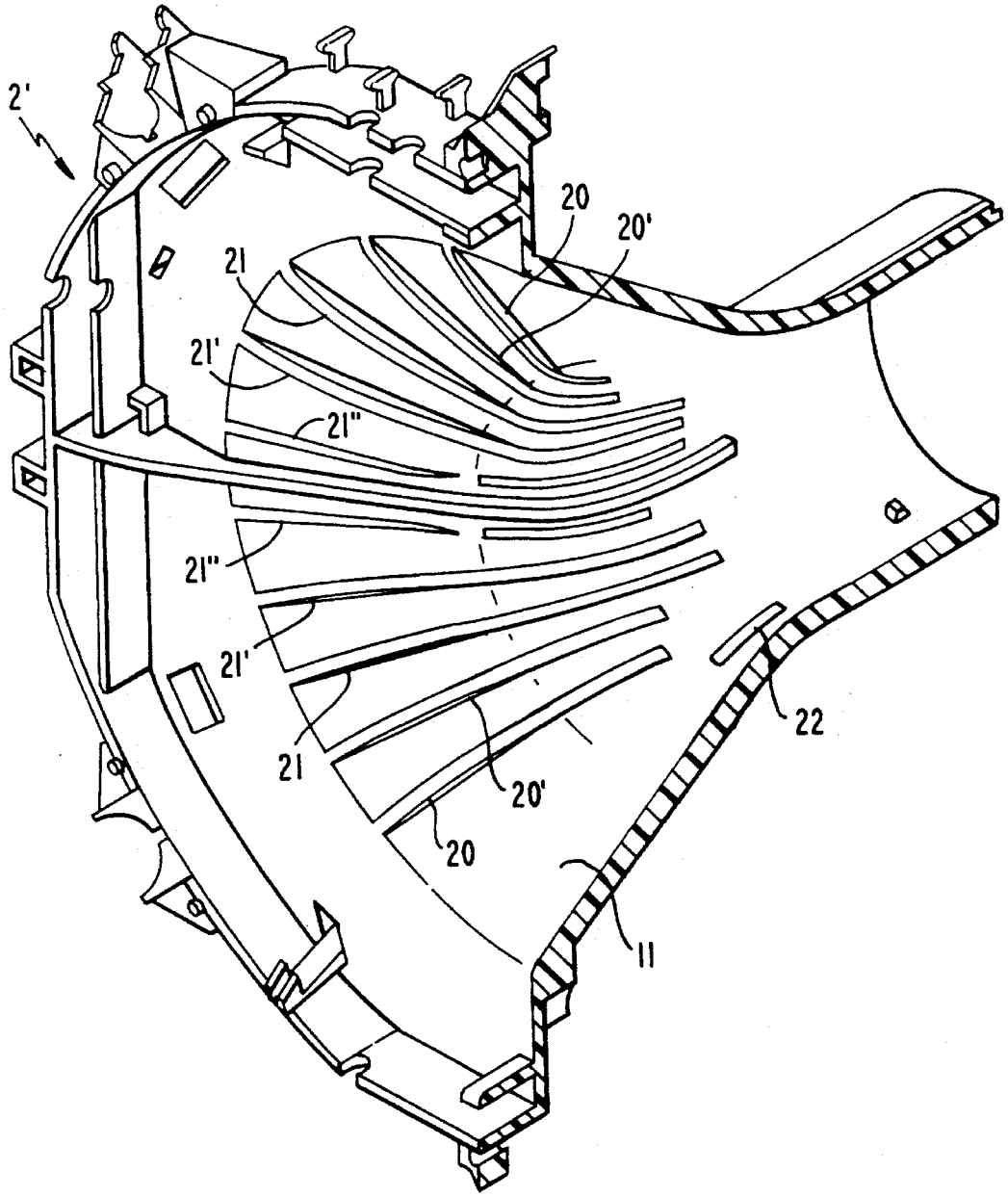
FIG. 5 illustrates the separator of FIG. 2 in a perspective view.

In carrying out an inventive feature, supporting ridges 20 20', 21, 21', 21" and 22' for example, of FIG. 5 or 2, bear against an outside surface of the horizontal deflection coils, not shown, and prevent the pair of horizontal deflection coils from bearing or pressing against inside surface 11. Therefore, advantageously, the outside surface of the horizontal deflection coils is displaced from surface 11 by an amount that is not affected by the shape of the vertical deflection coils.

Supporting ridges 20, 20', 21, 21', 21" and 22' are arranged on the intersection of corresponding radial planes, containing the Z axis, with surface 11. Such arrangement provides, advantageously, simplicity of maintaining manufacturing molds of the separator and facilitates the positioning of the parts needed for the release of sections of the mold. The radial arrangement has an advantage of better conforming to the shape of the deflection coils. This is so because the structure of the saddle shaped coils is defined radially by packets of conductors arranged at predetermined angles. As an alternative, the supporting ridges could be placed in planes parallel to one of the main axes provided that the surface of the ridge remains in contact with the surface of the deflection coils and supports the outside surface of the horizontal deflection coils.

These supporting ridges may be unequal in length. For example, supporting ridges 20 and 20' extend on a hollowed-out part of the separator, from a coordinate Z0 of FIG. 3 close to the screen, to an intermediate coordinate Z1. In region Z0–Z1, the horizontal deflection coils can be displaced from the vertical deflection coils in the radial direction by the largest amount. Ridges 22, for example, are located only in the rear cylindrical ring-shaped part of the separator, between coordinates Z2–Z3. Ridges 22 support a rear rounded section of the horizontal deflection coil. Supporting ridges 21, 21', and 21" extend from the front to the back, between coordinates Z0–Z3.

Because of the symmetry of the deflection coils with respect to the horizontal and vertical radial planes, as shown in FIG. 2, the supporting ridges are arranged on face 11 according to the same planes of symmetry. For example, the ridges disposed between 0° and 90° are symmetrical with respect to the X-axis to the ridges disposed between 270° and 360°.

The supporting ridges can be produced in the same molding step in which the rest of the separator is produced and, therefore, can be made of the same plastic material as the rest of the separator. Alternatively, the supporting ridges could be arranged on face 11 after the molding of the separator body is completed and could be attached to the main body of the separator, for instance, by means of bonding. In this case, the material of which the supporting ridges is made could be different from that of the main body of the separator.

Figure 4:
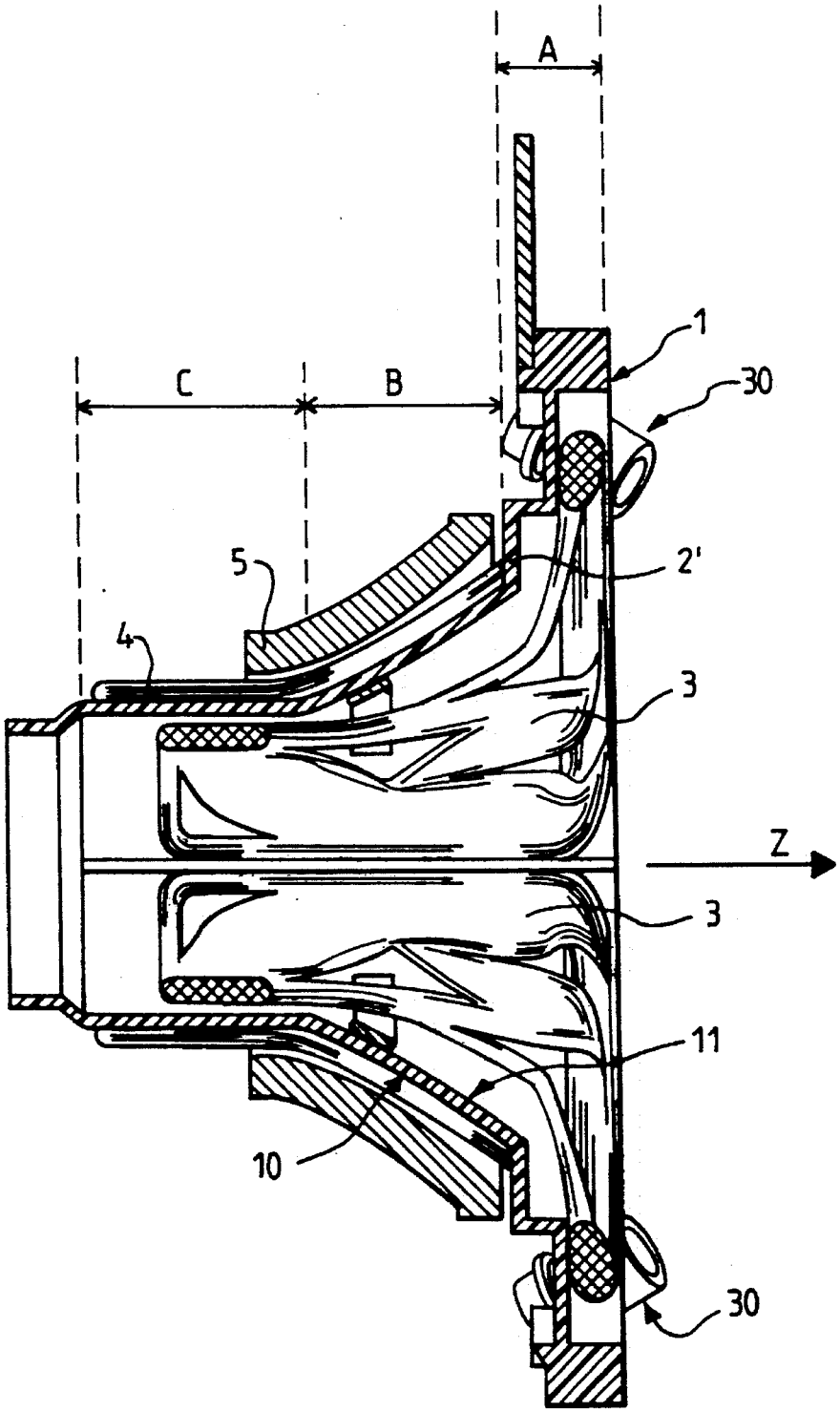
FIG. 4 illustrates a deflection yoke in a sectional side view along lines 4—4 of FIG. 2 that includes the separator.

FIG. 4 illustrates a deflection yoke that includes separator 2' of FIG. 2. Similar symbols and numerals in FIGS. 1–4 indicate similar items or functions. In the deflection yoke of FIG. 4, separator 2' includes a front portion defining a zone A along the Z-axis. The front portion in zone A is used for adjustment of the yoke on the CRT by an adjustable screw, not shown. The adjustable screw is threaded in a housing 30. An intermediate portion of the yoke defines a zone B that is hollowed in which the main deflection is performed. A rear section that defines a zone C has a cylindrical tube form and surrounds a neck of the CRT, not shown.

The height of a given supporting ridge such as ridges 20, 20', 21, 21' or 22 of FIGS. 2 and 3 may be variable. The height is defined at each coordinate by the distance that is required to be maintained between the horizontal and vertical deflection coils. For example, supporting ridges 20, disposed on the internal face of a separator of a 90 cm diagonal screen tube manufactured by Thomson Tubes and Displays could reach a maximum height of 2 mm at zone B of separator 2' of FIG. 4. In comparison, the thickness of the separator itself is around 1 mm.

Another advantage of the way separator 2' of FIGS. 2 and 3 is constructed is the ease with which a horizontal deflection coil modification can be made. Thus, for a given modification of the horizontal deflection coil, modification at selected coordinates of the height of the supporting ridges can be accomplished without changing anything else in faces 10 and 11.

To improve the quality of the picture, it may be desirable to have a line-scan frequency greater than 16 KHz such as, for example, 32 KHz or 64 KHz. At these frequencies, the energy consumption of the deflection coils is high, which may cause the coils to overheat. The conveyance of the heat may be an important requirement because over-heating could cause deformation or destruction of the coils and the separator. Advantageously, because the horizontal deflection coils do not bear against face 11 but are displaced by supporting ridges 20, 21 and 22, for example, in the radial direction, air can circulate between surface 11 of separator 2' and the coils. Thus, the tunnels formed between surface 11, the ridges and a surface of the horizontal deflection coils improve heat conveyance and provide cooling effect.

What is claimed is:

1. A deflection yoke for a cathode ray tube, comprising:

a deflection coil; and a separator for supporting said deflection coil, said separator having a plurality of support ridges for supporting said deflection coil that bears against said support ridges in a manner to space said deflection coil from a surface of said separator, said supporting ridges extending in a longitudinal direction between a front portion and a rear portion of the separator, a given one of said supporting ridges being placed at an intersection of a surface of said separator with a radial plane.

2. A deflection yoke according to claim 1, wherein said supporting ridges are arranged on an inner surface of the separator.

3. A deflection yoke according to claim 1, wherein a given support ridge of said supporting ridges has a variable height along a longitudinal axis.

4. A deflection yoke according to claim 1, wherein said deflection coil is a horizontal deflection coil.

5. A deflection yoke according to claim 1, wherein a first plurality of said supporting ridges are arranged in a rear part of said separator.

6. A deflection yoke according to claim 1 wherein said supporting ridges are of unequal length.

7. A deflection yoke according to claim 1, wherein said deflection coil is saddle-shaped.

8. A deflection yoke according to claim 1, wherein inside and outside faces of the separator form a body having a constant thickness and said ridges protrude from said body.

9. A deflection yoke according to claim 1 further comprising a second deflection coil wherein said separator isolates said deflection coils from each other.

* * * * *